United States Patent [19]

Hager

[11] Patent Number: 4,693,196

[45] Date of Patent: Sep. 15, 1987

[54] APPARATUS FOR MONITORING SHUTTLE THREAD SUPPLY OF A SEWING MACHINE

[75] Inventor: Walter Hager, Kaiserslautern, Fed. Rep. of Germany

[73] Assignee: Pfaff Industriemaschinen GmbH, Fed. Rep. of Germany

[21] Appl. No.: 810,648

[22] Filed: Dec. 18, 1985

[30] Foreign Application Priority Data

Dec. 21, 1984 [DE] Fed. Rep. of Germany ..... 3446682

[51] Int. Cl.[4] ..... D05B 45/00; D05B 69/18

[52] U.S. Cl. ..... 112/273; 112/278

[58] Field of Search ..... 112/273, 278, 121.11, 112/275, 277; 250/561, 571

[56] References Cited

U.S. PATENT DOCUMENTS 4,195,292 3/1980 Puhich ..... 112/278 X
4,195,582 4/1980 Novick et al. ..... 112/121.11
4,432,297 2/1984 Kemmel ..... 112/278

*Primary Examiner*—Peter Nerbun
*Attorney, Agent, or Firm*—McGlew and Tuttle

[57] ABSTRACT

An arrangement for monitoring the shuttle thread reserve in a sewing machine with a lockstitch revolving shuttle and with a light-emitting diode, which sends a beam of light through openings in the bobbin housing and in the bobbin to a photodetector which triggers a switching pulse for an actuating device. To obtain maximum utilization of the residual thread, the photodetector is used at the same time as a pulse generator for a counter which controls the actuating device. The counter can be connected to a switch-off device of a drive motor for the sewing machine.

5 Claims, 2 Drawing Figures

COUNTER
SWITCH
MICROCOMPUT.
E2
E1
A5
A4
A3
A2
A1
FF
S
R
Q
A
E
E1
E2
R
+
+

APPARATUS FOR MONITORING SHUTTLE THREAD SUPPLY OF A SEWING MACHINE

FIELD AND BACKGROUND OF THE INVENTION

The present invention relates in general to sewing machines and in particular to a new and useful apparatus for monitoring the supply of thread in a rotary hook or shuttle by utilizing a photodetector which also serves as a pulse generator which is used in conjunction with counting means.

A household sewing machine according to U.S. Pat. No. 4,432,297, has means for turning on an indicating device as soon as the thread reserve on the bobbin has fallen below a certain amount. With the indication of a predetermined remainder of thread, the operator will be able, with certainty, to complete a started job before the shuttle thread is used up. But such a measure has the disadvantage that usually a considerable remainder of thread is left on the bobbin to be changed, which must be removed before a new bobbin is filled. In addition, the shuttle thread capacity is not sufficiently utilized. To use such an arrangement in commercial sewing it is desirable, therefore, to use up the remaining shuttle thread as much as possible.

SUMMARY OF THE INVENTION

It is the object of the present invention to improve on known thread monitors so that the thread supply on the bobbin can be utilized for the sewing process to a large extent.

Accordingly another object of the invention is to provide an apparatus for monitoring a shuttle thread supply in a sewing machine with a lockstitch revolving shuttle or hook, and with a light-emitting diode which sends a beam of light through openings in a bobbin housing and in a bobbin of the shuttle, to a photodetector which triggers a switching pulse for actuating means, comprising counting means connected to the photodetector, the photodetector acting as a pulse generator for the counting means, and additional actuating means connected to and controllable by the counting means. Another object of the invention is to provide such an apparatus wherein the additional actuating means comprises a turn-off device which is connected to a drive motor of the sewing machine and which is controllable by the counting means.

By the arrangement of the invention, the stopping of the sewing machine can be adapted quite accurately to the end of the existing thread supply. In addition, a normally required separate pulse generator is not needed. Besides, a pulse generator coupled with the main shaft would indicate a thread consumption value which is dependent on the set stitch length and on the thickness of the work to be sewn and would therefore be usable only in a limited manner.

A still further object of the invention is to provide an apparatus for monitoring the shuttle thread of the sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENTS

Figure 1:
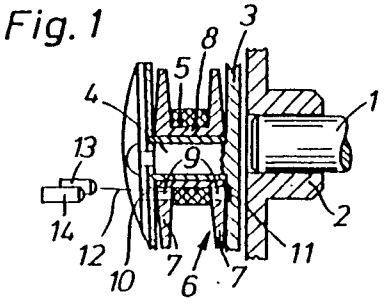
FIG. 1 is a partial sectional view of a rotary hook or shuttle drive of a sewing machine in accordance with the present invention.

The shuttle drive shown in FIG. 1 comprises a drive shaft 1, driven by a main shaft (not shown), on which is secured a shuttle or rotary hook body 2 which is shown only partially. In it is mounted, in a known manner (not shown), a bobbin capsule 3 comprising a center pin 4 which carries a bobbin 6 to be filled with thread 5. The bobbin comprises, in known manner, flanges 7 which are carried by a sleeve 8 to be placed on the center pin 4. In the vicinity of sleeve 8, each of the two flanges 7 has a coaxially arranged opening 9 which is aligned with a corresponding opening 10 in the bobbin capsule 3 provided at the same radial distance from the center pin 4.

The bobbin capsule 3 has a polished reflection surface 11 for reflecting a light beam 12 which is emitted by a diode 13 and guided through the openings 9 and 10 onto the reflection surface 11 as soon as the bottom thread 5, wound on bobbin 6, has been drawn off far enough. From the reflection surface 11 the light beam 12 is sent back through the openings 9 and 10 and strikes a photodetector 14.

With the sewing machine being driven, the bobbin capsule 3 stands still while the shuttle body 2 rotates. During the sewing process the bobbin 6 rotates at very low speed, due to the pulling off of the shuttle thread 5. The position of the opening 10 and of the reflection surface 11 on capsule 3 does not change relative to the axis of the light beam 12 between diode 13 and photodetector 14, while the openings 9 in bobbin 6 permit passage of the light beam 12 once during each revolution of the bobbin.

Figure 2:
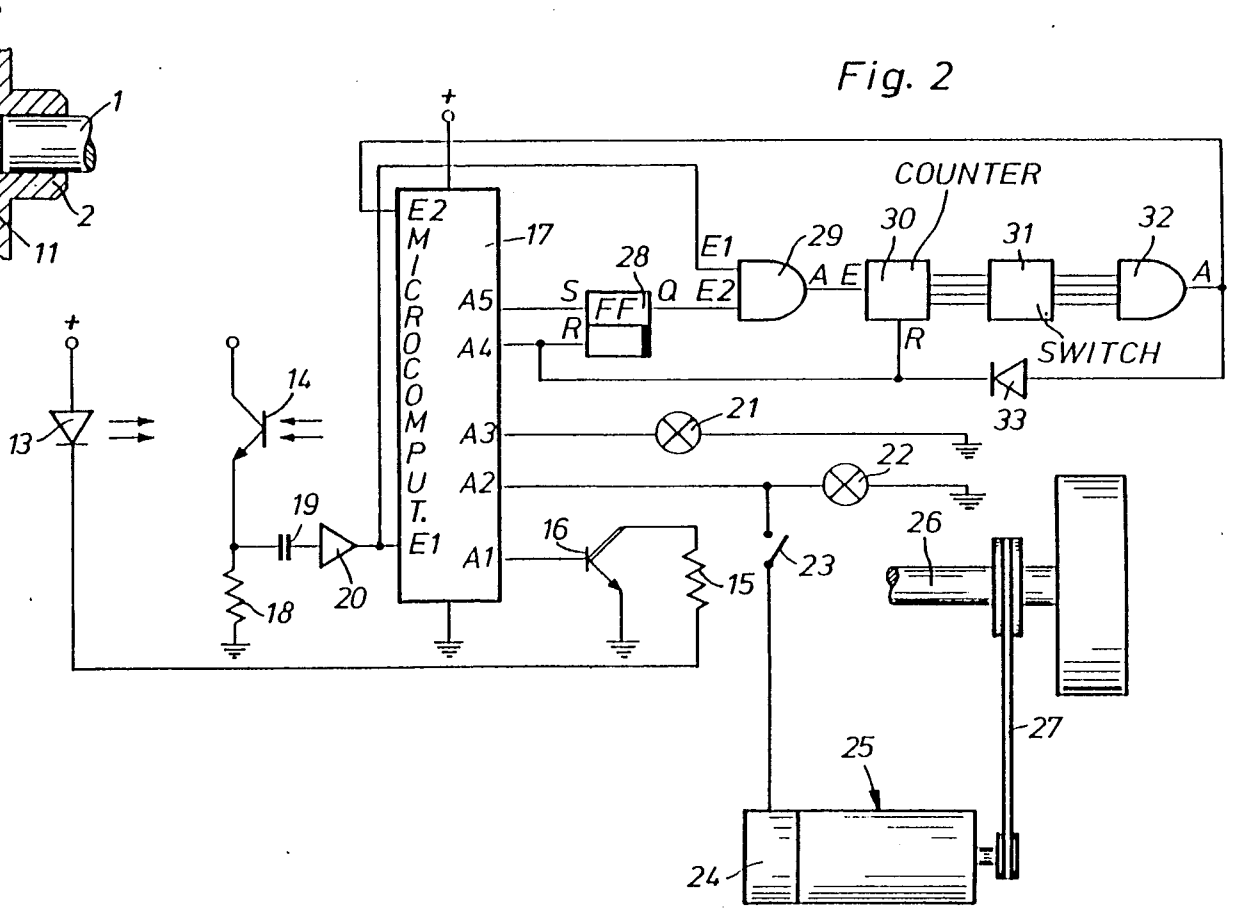
FIG. 2 is a simplified circuit diagram of the control for the thread supply monitor of the invention.

FIG. 2 shows a simplified circuit diagram of the parts required for the operation of the electric control of the thread monitor. From the positive pole (+) of a controlled voltage source, current flows via the light-emitting diode 13, a resistor 15, and a Darlington transistor 16 to ground. The base of the Darlington transistor 16 is connected to the output A1 of a microcomputer 17. From the positive pole (+) of the voltage source, current also flows via the photodetector 14, consisting of a photo transistor, and via a resistor 18 to ground. At the emitter of photodetector 14, a capacitor 19 is connected which in turn is connected via an amplifier 20 to an input E1 of the microcomputer 17. An output A3 of the microcomputer 17 is connected to ground via a light-emitting diode serving as display element 21. In addition, an output A2 of the microcomputer 17 is connected to a display element 22 and, via a switch 23, to a turn-off device 24 of a drive motor 25 which drives a main shaft 26 of the sewing machine through a V-belt 27.

An output A4 of the microcomputer 17 is connected to the reset input R of a flip-flop element 28, whose setting input S is connected to an output A5 of the microcomputer 17. The output Q of flip-flop element 28 is connected to the input E2 of an AND gate or element 29, whose input E1 is connected to the input E1 of the microcomputer 17 and whose output A is connected to the input E of a counter 30. The outputs are connected to the inputs of an AND gate or element 32. The output of the AND gate or element 32 is connected to the input E2 of the microcomputer 17 and, via a diode 33, to the reset input R of counter 30 as well as to the reset input R of the flip-flop element 28.

The arrangement operates as follows:

During operation of the sewing machine, light beam 12 is radiated from the light-emitting diode 13 onto the opening 10 in the bobbin capsule 3. As soon as the shuttle thread 5 on bobbin 6 has diminished to the extent that beam 12 can at least partly pass through the openings 9 in bobbin 6, it is reflected by the reflection surface 11 of the bobbin capsule 3 onto the photodetector 14. In that case the detector 14 conducts and current flows via resistor 18 to ground. The voltage thus building up is supplied via capacitor 19 and amplifier 20 to the input E1 of the microcomputer 17. Advantageously, the capacitor 19 serves to filter out direct currents caused by daylight and alternating currents of low frequency caused by a sewing light which may be used with the sewing machine.

With the first pulse of the photodetector 14, the microcomputer 17 turns display element 21 on via its output A3, which indicates to the operator the approaching end of the thread supply on bobbin 6. At the same time the microcomputer 17 sends, via its output A5, a start pulse to the input S of the flip-flop element 28, so that the flip-flop is brought into its operating position and its output Q supplies a high or H potential to one input of the AND element 29. The later pulses which, through the clearing of the openings 9 in bobbin 6, are now delivered by the photodetector 14 with every revolution of bobbin 6, enter the counter 30 via the input E1 of the other input of AND element 29. The counter counts upward until a certain counting result, which is preset at the preselection switch 31, is reached. At this point an H potential exists on all lines of the preselection switch connected to the AND element 32. The AND element 32 then delivers a control pulse to the input E2 of the microcomputer 17 and at the same time, via diode 33, sets the counter 30 to "0" via the reset input R thereof and switches the flip-flop element 28 to inactive position via its input R, whereby the AND element 29 is turned off again. At the same time the display element 21 is also turned off again.

The control pulse at input E2 of the microcomputer 17 switches the display element 22 on, via the output A2 and, when switch 23 is closed, also actuates the switching device 24 which turns the drive motor 25 off. This then, in a manner known, causes the stopping of the sewing machine in the next high position of the needle.

The length of the shuttle thread 5 still on bobbin 6 when the photodetector 14 responds, and which depends on its thickness, determines the remaining revolutions of bobbin 6 to exhaustion of the shuttle thread 5. The number of these revolutions can be determined for example by experiments and can be made of use for the setting of the preselection switch 31.

The operator has the possibility to stop the sewing machine just before exhaustion of the shuttle thread 5, by closing switch 23. When making short seams however, when from the start of the counting process a certain number of complete sewing processes can still be executed without using up all the thread, the operator can set the preselection switch 31 accordingly and can use only the display element 22 for indication of the approaching end of the thread. The operator then opens switch 23. This is done as soon as the display element 22 indicates the approaching end of the shuttle thread 5. The started short seam can thus still be finished before the bobbin 6 is changed or filled with new shuttle thread 5.

While a specific embodiment of the invention has been shown and described in detail to illustrate the application of the principles of the invention, it will be understood that the invention may be embodied otherwise without departing from such principles.

What is claimed is:

1. An apparatus for monitoring a shuttle thread supply in a sewing machine with a lockstitch revolving shuttle, comprising a light-emitting diode which sends a beam of light through openings in a bobbin housing and in a bobbin of the shuttle, a photodetector for receiving light from the bobbin housing when a supply of thread on the bobbin falls to a selected amount and which thereby triggers a switching pulse for actuating means, counting means connected to the photodetector for counting to a number corresponding to the selected amount of thread on the bobbin, said counting means counting toward the number each time light is received by the photodetector, the photodetector acting as a pulse generator for said counting means, and additional actuating means connected to and controllable by the counting means when the number has been reached by said counting means.

2. An apparatus according to claim 1, wherein the additional actuating means comprises a turn-off device connected to a drive motor of the sewing machine, the counting means being connected to the turn-off device for control thereof.

3. An apparatus according to claim 2, wherein the counting means comprises a microcomputer having a first input connected to the photodetector for receiving pulses therefrom which are generated with the rotation of the bobbin, the microcomputer having a second input for receiving a control pulse, the microcomputer having a first output connected to the turn-off device for controlling the turn-off device to turn-off the drive motor upon the occurrence of the .control pulse, the microcomputer having a second output, a logic circuit connected to the second output and containing a counter for counting a selected number of pulses from the photodetector and, upon reaching the selected number of pulses, generating the control pulse, the counter having an output connected to the second input of the microcomputer for applying the control pulse to the second input of the microcomputer.

4. An apparatus according to claim 3, wherein the logic circuit comprises a flip-flop having a setting input connected to the second output of the microcomputer and a control output, a first AND gate having one input connected to the control output of the flip-flop and another input connected to the photodetector for receiving pulses from the photodetector, the first AND gate having an output connected to the counter.

5. An apparatus according to claim 4, including a preselection switch having a plurality of inputs connected to said counter and a plurality of outputs, a second AND gate connected to said outputs of said switch, said second AND gate having an output connected to said second input of said microcomputer for generating the control pulse when all inputs of the AND gate receive a signal from the switch.

* * * * *